United States Patent [19]

Eisenmenger et al.

[11] 4,197,221

[45] Apr. 8, 1980

[54] CARBON BLACK CONCENTRATE

[75] Inventors: Edith Eisenmenger, Offenbach; Lutz Dworowy, Brühl; Günther Fuchs, Cologne; Lothar Rothbühr, Hürth-Hermulheim; Hans Schafer, Linsengericht, all of Fed. Rep. of Germany

[73] Assignee: Deutsche Gold- und Silber-Scheideanstalt vormals Roessler, Frankfurt, Fed. Rep. of Germany

[21] Appl. No.: 845,840

[22] Filed: Oct. 26, 1977

[30] Foreign Application Priority Data

Oct. 27, 1976 [DE] Fed. Rep. of Germany ..... 2648539

[51] Int. Cl.[2] ..... C08L 1/18

[52] U.S. Cl. ..... 260/16; 106/193 R; 106/195; 106/26; 106/27; 106/308 F

[58] Field of Search ..... 106/193, 195, 26, 27, 106/308 F, 307; 260/16

[56] References Cited

U.S. PATENT DOCUMENTS

| | | | |
|---|---|---|---|
| 2,544,363 | 3/1951 | Siemons | 106/195 |
| 3,617,323 | 11/1971 | Riegler | 106/308 F |
| 4,022,724 | 5/1977 | Joachim et al. | 260/16 |
| 4,032,354 | 6/1977 | Fraser | 106/264 |

OTHER PUBLICATIONS

Chem. Abst. 48:14,240c, 1954.
Chem. Abst. 55:15,955c, 1960.
Chem. Abst. 63:4984b, 1965.
Ullman's Enzyklopadie der technischen Chemie, vol. 11, pp. 279 et seq. and vol. 8, pp. 316 et seq.

*Primary Examiner*—Theodore Morris
*Attorney, Agent, or Firm*—Cushman, Darby & Cushman

[57] ABSTRACT

There is provided a carbon black concentrate of the following composition:

| | |
|---|---|
| Carbon Black | 10 to 50 weight % |
| Plasticizer | 5 to 30 weightt % |
| Nitrocellulose Compatible Alkyd Resin | 0 to 30 weight % |
| Nitrocellulose Staple Fibers | 30 to 80 weight % |
| Dispersing Agent Consisting of Metal Oleates or Metal Octoates | 0.5 to 2.5 weight % |

The concentrate is useful as a pigmenting agent, e.g., for lacquers and printing inks.

10 Claims, No Drawings

CARBON BLACK CONCENTRATE

BACKGROUND OF THE INVENTION

The invention is directed to a carbon black concentrate, its production and its use as a pigmenting material in lacquers or printing inks.

Carbon black is added to a great extent in the production of black lacquers and printing inks. There exists in carbon blacks in a known manner a dependency between the blackness and the primary particle size. Deep black carbon blacks corresponding to a higher surface area have a lower primary particle size. Carbon blacks with a lower degree of blackness on the contrary have larger primary particle sizes and relatively low surface areas. Carbon blacks with high surface areas generally are poorly dispersible in liquid binding agent systems. Therefore, a high amount of dispersing work must be expanded to distribute these carbon blacks in binders for lacquers and printing inks and to open up the optimum capacities of these carbon black qualities in the dispersing.

Known apparatus which are used to distribute pigments in thinly liquid binder systems are for example ball mills or bead mills. Known apparatus which are used to distribute pigments in viscous plastic binder systems are for example intermittent or continuous kneaders. These apparatus, however, mean a high energy expense. Furthermore, there are a number of binders which cannot tolerate the high temperatures that for example are developed in the kneading and can be decomposed either slowly or explosively.

In order to eliminate these difficulties there have been endeavors to produce carbon black concentrates in the particular binders. These carbon black concentrates then need merely be swollen in solvents and be introduced into the particular lacquer or printing inks without special shearing forces in order to produce the desired lacquer or printing inks. In order to attain a good dispersion of finely divided carbon blacks of larger surface area without a too high loading of the binder there have been endeavors to improve the dispersibility of the finely divided carbon blacks by addition of dispersing agents. Particularly important is the use of a dispersing agent in the working up of nitrocellulose binders because in this case a too strong mechanical working in of the carbon black can lead to explosive decomposition of the nitrocellulose. The quality of the carbon black-binder preparation is frequently decisive for the type of dispersing agents. In selection of the dispersing agent is is important that this dispersing agent produce no negative properties or changes in the final systems in which it is added.

In known carbon black concentrates there are primarily used as dispersing agents amine containing compounds, as, e.g., benzidine and phenylene diamine. The amines usable as dispersing agents have poor solubility in test gasoline or xylene. This forms pimples and spots in the lacquer coating insofar as there is not carried out an additional operation for clarification, as, e.g., centrifuging. Their use as pigmenting agents because of their amine content is physiologically objectionable.

SUMMARY OF THE INVENTION

The object of the invention is a carbon black concentrate having the following composition:

| | |
|---|---|
| Carbon Black | 10 to 50 weight % |
| Plasticizer | 5 to 30 weight % |
| Nitrocellulose Compatible Alkyd Resin | 0 to 30 weight % |
| Nitrocellulose Fibers | 30 to 80 weight % |
| Metal Oleate or Metal Octoate Dispersing Agent | 0.5 to 2.5 weight % |

As the dispersing agent for the carbon black concentrate there can be used for example alkaline earth oleates, e.g., barium oleate, calcium oleate, strontium oleate or magnesium oleate or alkaline earth octoates, e.g., barium octoate, magnesium octoate, calcium octoate or strontium octoate. The preferred dispersing agent is barium octoate.

Preferably the carbon black concentrate of the invention contains 12 to 25 weight % of carbon black. In a further preferred form of the invention the carbon black concentrate contains besides 12 to 25 weight % of carbon black, 1% of barium octoate as dispersing agent.

When the alkyd resin is employed it is usually present in an amount of at least 0.1 weight %.

A further object of the invention is a process for the production of the carbon black concentrate of the invention which is characterized by the constituents nitrocellulose (wet with isopropanol), plasticizer, dispersing agent and, in a given case, the alkyd resin with the addition of a solvent are mixed to a plastic mass, the carbon black kneaded into this premixed composition, the thus produced product rolled out to sheets for further dispersion of carbon black and for evaporation of the solvent and subsequently broken into chips.

As plasticizers there are intended plasticizing agent, plastifying agents, plastification agents. These materials are added to a plastic composition (synthetic or natural resin) in order to improve their softness, pliability, elasticity and workability.

The plasticizers are above all important for the lacquer and synthetic resin sector. They should impart to, for example, organic film-formers (resins, natural rubber, butadiene-styrene, butadiene-acrylonitrile, linseed oil, varnishes, polyvinyl products, cellulose acetate, nitrocelluloses and the like) adhesiveness, pliability, elasticity and toughness and in synthetic resins improve the pliability. In contrast to the solvents the plasticizers have a high boiling point (about 250° C.); they do not evaporate after the coating but combine with the film former to physically homogeneous compositions.

An ideal plasticizer should be odorless, colorless, light stable, cold stable, heat stable, non-hygroscopic, water resistant, non-injurious to health, difficult to burn and with as slight volatility as possible; it should react neutral, it should be grindable with pigments on roller carriage arms and have a good solubility for resins or cellulose esters.

The preferred plasticizer groups are phthalates, e.g., alkyl, aralkyl and cycloalkyl phthalates such as dioctyl phthalate (DOP), dimethyl phthalate, diethyl phthalate, dibutyl phthalate (in some cases in combination with diethyl phthalate), dicyclohexyl phthalate, high molecular weight alcohol esters such as didecyl phthalate and ditridecyl phthalate, mixed ester plasticizers such as butyl octyl phthalate, butyl decyl phthalate and butyl benzyl phthalate, diamyl phthalate, di(2-ethylhexyl) phthalate, di(methoxyethyl) phthalate, dicapryl phthalate and the like, alkyl and aryl phosphates, e.g., tricresyl phosphate, triphenyl phosphate, triphenyl phosphate in combination with tricresyl phosphate and/or phthalates, diphenyl cresyl phosphate, diphenyl 2-ethylhexyl phosphate, tris(2-ethylhexyl) phosphate, tris(butoxyethyl) phosphate; acyclic (aliphatic) dicarboxylic acid esters as for example alkyl and aralkyl esters of adipic acid and sebacic acid, e.g., dioctyl adipate, didecyl adipate, dicapryl adipate, dibutyl sebacate, di(2-ethylhexyl) sebacate, dioctyl sebacate, dihexyl sebacate, butyl benzyl sebacate and the like.

Also, there can be used fatty acid esters, e.g., alkyl esters such as butyl oleate and butyl stearate and castor oil esters, e.g., the methyl and butyl esters of acetylated castor oil, fatty acid glycol esters, e.g., ethylene glycol distearate, triethylene glycol-di-(2-ethylbutyrate), esters of epoxystearic acid, e.g., the methyl ester and the butyl ester, citric acid esters, as for example acetyl tributyl citrate, acetyl triethyl citrate.

Furthermore, there can be used polymeric plasticizers such as for example polyesters of dicarboxylic acids, e.g., adipic acid, sebacic acid and phthalic acid with glycols, e.g., propylene glycol, ethylene glycol, 2-ethyl-1,3-hexanediol and the like, on occasion in part modified with monofunctional acids or alcohols, having molecular weights of about 850 to 8000. Also epoxidized oils and butadiene-acrylonitrile copolymers can be used as polymeric plasticizers.

Nitrocellulose compatible alkyd resins are found in the group of castor oil alkyd resins and the group of non-drying alkyd resins. The resistance against yellowing is important to avoid influencing the color of the carbon black concentrate.

As solvents there can be used, for example esters, e.g., alkyd alkanoates, and ketones as for example ethyl acetate, butyl acetate, acetone and methyl ethyl ketone. They can be added in an amount of 0.5 to 10 weight % based on the total amount of the individual components.

As carbon blacks there can be used furnace blacks as well as gas blacks and flame blacks. Particularly advantageous are oxidized blacks on a flame black or gas black basis. These are distinguished by a volatile component content of above 3%.

The carbon black concentrate of the invention has the advantage that its components, above all the metal oleate or metal octoate are readily soluble in test gasoline or xylene. It is easily dispersed without the formation of spots. The workability into printer's roller composition is substantially more favorable. The varnish or lacquer coatings produced with the carbon black concentrate of the invention show a substantially more favorable degree of luster as well as a higher densitometer value. The carbon black concentrates of the invention can contain a high portion of carbon black which permits cheaper transportation.

The carbon black concentrate of the invention can be used as a pigmenting agent for lacquers (or varnishes). Thereby there is mixed into the lacquer (or varnish) system 0.01 to 20 weight % of the carbon black concentrate.

Under lacquer and painting agents there are understood liquid to pasty materials or mixtures of materials which are applied to the surface to be painted by various processes such as painting or spraying and which paint gives to the base an adherent coating by physical or chemical drying.

Painting agents are systems which are composed of different components:

| | | |
|---|---|---|
| 1. Non-Volatile Components | (a) film forms | |

-continued

| | | |
|---|---|---|
| | (b) resin<br>(c) plasticizer | binder |
| | (d) pigments | |
| | (e) adjuvants | |
| 2. Volatile Components | (a) solvent | |
| | (b) diluent | |

For further description of the concept of lacquers reference is made to Ullmann's Enzyklopädie der technischen Chemie, Vol. 11, pages 279 et seq. (3rd edition).

Furthermore, the carbon black concentrate of the invention can be used as pigmentation agent for printing inks as for example newspaper printing inks, book printing and job inks, illustration and autotyping printing inks, glossy printing inks, heat setting inks or moisture and steam setting inks which are added in the various printing processes such as relief printing, offset printing, lithoprinting, intaglio printing, etc.

The newspaper printing inks generally consist of carbon black (flame black or gas black) and a resin, bitumen, rosin oil or mineral oil containing binder (composition varnish, resin varnish). Because of the rapid printing process they are made up as very thin liquids; they are tied to the newspaper printing paper by absorption and resinification.

Book printing and job inks are used for printing books, printing on posters, commercial paper, etc. They contain better carbon blacks and binders based on linseed oil varnishes and resin varnishes; they dry by oxidation and by sinking into the ink carrier (paper).

The illustration and autotyping printing inks are included among the most valuable printing inks which are produced using gas blacks and linseed oil varnishes or other drying oils as binders.

The black printing inks depending on the quality of the carbon black or the binder frequently show a certain browning; they are toned up by the addition of solutions of bluer and violeter colors or milori blue and reflex blue.

For heating setting inks there is used as the binder, for example, nitrocellulose (low viscosity) or cyclized rubber in diethylene glycol monobutyl ether, dibutyl phthalate and blown castor oil. The binder is so constituted that it does not dry on the rolls of the printing machine but is immediately solid at 150° C. through vaporization and polymerization when the ink passes with great speed the drying part attached to the printing machine.

Moisture and steam setting inks are characterized by using, for example, colophony or a synthetic resin dissolved in dibutylene glycol or diethylene glycol, etc., i.e., in a water-miscible solvent; the binder does not dissolve at normal temperature and is ground with pigments such as carbon black, etc., on a three roll mill. A printing ink so produced results in printing which stops moisture, vapors, etc., and immediately deposits the binder dry on the paper.

For relief printing processes there can also be mentioned offset printing which has acquired great importance for printing packages for foods and condiments; besides paper there is printed non-absorbing printing carrier such as viscose film, cellophane, metal films, etc.

For a further description of the concept of printing inks reference is made to Ullmann's Enzyklopädie der technischen Chemie, Vol. 8, 3rd edition page 316 et seq. (graphische Farben (graphic colors)).

The compositions can comprise, consist essentially of or consist of the materials set forth and the process can comprise, consist essentially of or consist of the steps set forth.

Unless otherwise indicated, all parts and percentages are by weight.

The invention will be further illustrated in connection with the following examples which are not intended to limit the invention.

DESCRIPTION OF THE PREFERRED EMBODIMENTS

Example 1

A carbon black concentrate was produced having the following dry composition:

| Basic Recipe | |
|---|---|
| Carbon Black FW2 ® (High Colour Black) | 14.0 weight % |
| Dibutyl Phthalate | 14.0 weight % |
| *Nitrocellulose Compatible Alkyd Resin | 16.0 weight % |
| Nitrocellulose Fibers E620 Solid | 55.25 weight % |
| Dispersing Agent | 0.75 weight % |

*A fatty acid / phthalic anhydrid alkydresin for instance containing 28% fatty acid and 44% phthalic anhydride.

The carbon black FW2 is a finely divided gas black, has an electron microscopically determined particle size of 13μ, a BET surface area of 460 $m^2/g$, volatile constituents (determined at 940° C.) of 15% and a pH of 3.

The nitrocellulose is added wet with isopropanol.

To produce the carbon black concentrate the mixture components nitrocellulose (wet with isopropanol), dibutyl phthalate, alkyd resin and an addition of about 10% of ethyl acetate as solvent as well as the dispersing agent were mixed in a kneader to a plastic mass.

The carbon black was kneaded into this premixed composition. Subsequently, the thus produced product was withdrawn from the kneader in the form of lumps and rolled out on two rolls to further disperse the carbon black and evaporate the solvent to sheets and broken to so-called chips.

The testing of the products produced took place by dissolving in a nitrocellulose lacquer system.

| | |
|---|---|
| Carbon Black Concentrate | 10 parts by weight |
| Nitrocellulose Lacquer System | 90 parts by weight |

The nitrocellulose lacquer system was formed as follows:

| Nitrocellulose Lacquer | |
|---|---|
| Nitrocellulose Fibers E-330 (wet with isopropanol) | 18.0 parts by weight |
| Castor Oil Modified Alkyd Resin (Alftalat 143/5 60%) | 13.0 parts by weight |
| Maleinized Resin (Alresat 313/C) | 4.0 parts by weight |
| Dioctyl Phthalate (DOP) | 2.5 parts by weight |
| Carbamic Acid Resin Uresin-B | 5.0 parts by weight |
| Melamine-Formaldehyde Resin Maprenal NP/55% | 5.0 parts by weight |
| Xylene | 8.0 parts by weight |
| Butanol | 8.0 parts by weight |
| Ethylene Glycol Acetate | 5.0 parts by weight |
| Butyl Acetate | 14.0 parts by weight |
| Methyl Isobutyl Ketone | 16.5 parts by weight |
| Silicone Oil A/1% | 1.0 part by weight |
| | 100.0 parts by weight |

Coatings having a thickness of about 60μ were produced from the lacquer by spraying and evaluated as to the degree of blackness with a densitometer, as to the gloss with a gloss measuring apparatus and visually as to surface purity (spots). A higher densitometer index indicates a lacquer with a higher degree of blackness while a lower index indicates a lower degree of blackness. A high gloss number indicates a highly glossy surface for the lacquer. In the visual surface evaluation, the surface with the least spots is rated 1 and the surfaces with more spots with higher numbers.

| Dispersing Agent | Degree of Blackness (densitometer index) | Gloss Number % | Surface (Spots) |
|---|---|---|---|
| benzidine | 2.82 | 100 | 4 |
| p-phenylenediamine | 2.81 | 103 | 4 |
| copper naphthenate | 2.81 | 105 | 3 |
| copper oleate | 2.80 | 105 | 2 |
| copper octoate | 2.81 | 110 | 2 |
| barium octoate | 2.84 | 115 | 1 |

In regard to all of the test values, the group of octoates and oleates proved to be surprisingly particularly advantageous. The alkaline earth octoate (barium octoate) was the best.

Also, the working up of the carbon black concentrate of the invention is substantially more favorable than is the case with the use of diamines as the dispersing agent. Thus, the carbon black concentrates of the invention dissolved substantially more quickly.

EXAMPLE 2

| Carbon Black Concentration | Weight % | 22 | 25 | 28 | 32 | 36 |
|---|---|---|---|---|---|---|
| Color Black FW2 | Weight % | 22.0 | 25.0 | 28.0 | 32.0 | 36.0 |
| Dibutyl Phthalate | Weight % | 10.0 | 9.0 | 9.0 | 8.0 | 6.0 |
| Alkyd Resin | Weight % | 13.0 | 12.0 | 12.0 | 11.0 | 11.0 |
| Nitrocellulose E620 | Weight % | 53.9 | 52.7 | 49.5 | 47.2 | 45.0 |
| Barium Octoate | Weight % | 1.2 | 1.3 | 1.5 | 1.8 | 2.0 |

The carbon black concentrate was produced as described in Example 1 and broken into chips. The platelet shaped chips were worked into the nitrocellulose lacquer system described in Example 1.

With these lacquers there were produced both sprayed sheets and also overcoats by dipping. The degree of blackness was measured with a densitometer.

| | Degree of Blackness Densitometer Value | |
|---|---|---|
| 22% carbon black FW2 | 2.81 | 2.79 |
| 25% carbon black FW2 | 2.78 | 2.76 |
| 28% carbon black FW2 | 2.77 | 2.76 |
| 32% carbon black FW2 | 2.74 | 2.75 |
| 36% carbon black FW2 | 2.71 | 2.71 |

The results show that even at high concentrations of the extremely finely divided and high surface area carbon black FW2 easily dispersible carbon black-binder compositions are formed which result in deep black lacquer surfaces. Even in these highly concentrated compositions, the combination of the invention displays a high effectivess.

The carbon black concentrates with a high carbon black content additionally have the not insignificant advantage that they make possible a far more economical transport.

EXAMPLE 3

| Basic Recipe | |
|---|---|
| Carbon Black FW2 | 18.0% |
| Nitrocellulose E620 | 57.0% |
| Dibutyl Phthalate | 24.0% |
| Barium Octoate | 1.0% |

The composition was worked up as in Example 1 and tested.

| Degree of Blackness (densitometer index) | Gloss Number % |
|---|---|
| 2.81 | III |

A carbon black concentrate according to the invention without the nitrocellulose compatible alkyd resin likewise showed outstanding values.

What is claimed is:

1. A dry carbon black concentrate consisting essentially of:

| | |
|---|---|
| carbon black | 10 to 50 weight % |
| plasticizer | 5 to 30 weightt % |
| nitrocellulose compatible alkyd resin | 0 to 30 weight % |
| nitrocellulose fibers | 30 to 80 weight % |

-continued

| | |
|---|---|
| metal salt octoate | 0.5 to 2.5 weight % |

2. A carbon black concentrate according to claim 1 wherein the metal is an alkaline earth metal.

3. A carbon black concentrate according to claim 2 wherein the dispersing agent is barium octoate.

4. A carbon black concentrate according to claim 1 containing a nitrocellulose compatible alkyd resin.

5. A carbon black concentrate according to claim 1 free from alkyd resin.

6. A process for the production of the carbon black concentrate of claim 1 consisting essentially of mixing the nitrocellulose (wet with isopropanol), plasticizer, dispersing agent and a solvent to form a plastic composition, kneading carbon black into this composition, rolling out the product obtained into sheets to further disperse the carbon black and volatilize the solvent and thereafter breaking the product into chips.

7. A process according to claim 6 including a nitrocellulose compatible alkyd resin in the plastic composition prior to kneading in the carbon black.

8. A process according to claim 6 wherein the metal octoate is barium octoate.

9. A process according to claim 6 wherein the metal octoate is an alkaline earth metal octoate and the solvent is an ester or ketone.

10. A process according to claim 9 wherein the octoate is barium octoate.

* * * * *